US006347962B1

(12) United States Patent
Kline

(10) Patent No.: US 6,347,962 B1
(45) Date of Patent: Feb. 19, 2002

(54) CONNECTOR ASSEMBLY WITH MULTI-CONTACT GROUND SHIELDS

(75) Inventor: Richard Scott Kline, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/773,044

(22) Filed: Jan. 30, 2001

(51) Int. Cl.[7] ..... H01R 13/648; H01R 13/53
(52) U.S. Cl. ..... 439/608; 439/181
(58) Field of Search ..... 439/608, 607, 439/609, 610, 108, 79, 181, 183, 88

(56) References Cited

U.S. PATENT DOCUMENTS 5,066,236 A 11/1991 Brocksteeg ..... 439/79
5,620,340 A 4/1997 Andrews ..... 439/608
5,664,968 A * 9/1997 Mickievicz ..... 439/608
5,795,191 A * 8/1998 Preputnick et al. ..... 439/608
5,980,321 A * 11/1999 Cohen et al. ..... 439/604
6,123,554 A * 9/2000 Ortega et al. ..... 439/79
6,146,202 A * 11/2000 Ramey et al. ..... 439/608

* cited by examiner

*Primary Examiner*—Brian Sircus
*Assistant Examiner*—Chandrika Prasad

(57) ABSTRACT

A connector assembly is provided having a receptacle connector mateable with a header connector. The assembly includes an insulated housing and a plurality of terminal modules mounted to the insulated housing. The terminal modules have an insulated molded body enclosing multiple connector contacts having opposed mating portions. Each terminal module includes a contact formed into at least one differential pair. The connector assembly further includes conductive ground shields mounted to and located between the terminal modules. Each ground shield includes at least one ground contact pair located proximate at least one differential pair of connector contacts. The ground contact pair includes a primary ground contact and a secondary ground contact extending different distances from the body of the ground shield to electrically engage a corresponding header ground shield at two points along the length of the header ground shield to inhibit the header ground shield from operating as a radiating antenna.

23 Claims, 6 Drawing Sheets

CONNECTOR ASSEMBLY WITH MULTI-CONTACT GROUND SHIELDS

BACKGROUND OF THE INVENTION

The preferred embodiments of the present invention generally relate to an electrical connector assembly having a receptacle connector mateable with a header connector, in a small envelope and with high signal performance characteristics.

It is common, in the electronics industry, to use right angled connectors for electrical connection between two printed circuit boards or between a printed circuit board and conducting wires. The right angled connector typically has a large plurality of pin receiving terminals and, at right angles thereto, pins (for example compliant pins) that make electrical contact with a printed circuit board. Post headers on another printed circuit board or a post header connector can thus be plugged into the pin receiving terminals making electrical contact there between. The transmission frequency of electrical signals through these connectors is very high and requires not only balanced impedance of the various contacts within the terminal modules to reduce signal lag and reflection but also shielding between rows of terminals to reduce crosstalk.

Impedance matching of terminal contacts has already been discussed in U.S. Pat. Nos. 5,066,236 and 5,496,183. Right angle connectors have also been discussed in these patents, whereby the modular design makes it easy to produce shorter or longer connectors without redesigning and tooling up for a whole new connector but only producing a new housing part into which a plurality of identical terminal modules are assembled. As shown in the '236 patent, shielding members can be interposed between adjacent terminal modules. An insert may be used to replace the shield or a thicker terminal module may be used to take up the interposed shielding gap if the shielding is not required. The shield disclosed in the '236 patent is relatively expensive to manufacture and assemble. The shielded module disclosed in the '183 patent includes a plate-like shield secured to the module and having a spring arm in the plate section for electrically engaging an intermediate portion of a contact substantially encapsulated in a dielectric material. The shield arrangement of the '183 patent, however, requires sufficient space between adjacent through-holes of the board to avoid inadvertent short circuits. Furthermore, both the insulated module and the shield must be modified if the ground contact is to be relocated in the connector.

An alternative electrical connector assembly has been proposed in U.S. Pat. No. 5,664,968, in which each terminal module has a plurality of contacts including a mating contact portion, a connector connecting portion and an intermediate portion there between with some or all of the intermediate portions encapsulated in an insulated web. Each of the modules has an electrically conductive shield mounted thereto. Each shield includes at least a first resilient aim in electrical engagement with a selected one of the contacts in the module to which the shield is mounted and at least a second resilient arm extending outwardly from the module and adapted for electrical engagement with another selected contact in an adjacent terminal module of the connector assembly.

Conventional connector assemblies, such as in the '236, '183 and '968 patents, are typically designed for use both in single ended applications as well as in differential pair applications. In single ended applications, the entire signal is directed in a first direction along one conductor and then the entire signal is subsequently returned in the opposite direction along a different conductor. Each conductor is connected to a contact within a connector assembly, and thus the entire signal is directed in a first direction through one pin or contact and in the opposite direction through a separate pin or contact. In differential applications, the signal is divided and transmitted in the first direction over a pair of conductors (and hence through a pair of contacts or pins). The return signal is similarly divided and transmitted in the opposite direction over the same pair of conductors (and hence through the same pair of pins or contacts).

The differences in the signal propagation path of single ended versus differential pair applications cause differences in the signal characteristics. Signal characteristics may include impedance, propagation delay, noise, skew, and the like. The signal characteristics are also effected by the circuitry used to transmit and receive the signals. The circuitry involved in transmitting and receiving signals entirely differs for single ended and differential applications. The differences in the transmit and receive circuitry and the signal propagation paths yield different electrical characteristics, such as for impedance, propagation delay, skew and noise. The signal characteristics are improved or deteriorated by varying the structure and configuration of the connector assembly. The structure and configuration for connector assemblies optimized for single ended applications differ from connector assemblies optimized for use in differential pair applications.

Heretofore, it has been deemed preferable to offer a common connector assembly useful in both single ended and differential pair applications. Consequently, the connector assembly is not optimized for either applications. A need remains for a connector assembly optimized for differential pair applications.

Moreover, most connector assemblies must meet specific space constraints depending upon the type of application in which the connector assembly is used while maintaining high signal performance. By way of example only, certain computer specifications, such as for the Compact PCI specification, define the dimensions for an envelope in which the connector assembly must fit, namely an HM-type connector which represents an industry standard connector. However, the HM connector does not necessarily offer adequate signal performance characteristics desirable in all applications. Instead, in certain applications, higher signal characteristics may be preferable, such as offered by the HS3 connector offered by Tyco Electronics Corp.

However, certain conventional connectors that offer higher signals characteristics may not satisfy the envelope dimensions of an HM type connector standard. For example, an HM connector is designed to be mounted on the edge of a printed circuit board to connect the printed circuit board at a right angle to a daughter card. The HM connector includes a mating face that straddles the edge of the printed circuit board. The side of the HM connector is L shaped and affords a mating face located both above and below the printed circuit board surface. The contacts on an HM connector are staggered to straddle the edge of the printed circuit board. Certain types of connectors that offer high signal characteristics include contacts only along one side of the board, not staggered on either side of a printed circuit board.

By way of example only, certain convention al connectors, such as the HS3 connectors, include ground shields and signal contact terminals. The ground shields are located in the header connector and engage ground contacts in the receptacle connector when the header and receptacle connectors are joined. When mating the header and receptacle, it is preferable that the ground contact and ground shields engage one another before signal contacts in the header and receptacle engage one another.

However, in conventional connector assemblies, in order for tips of the ground contacts to engage the tips of the ground shields first, they should be longer than the signal contacts. The ground contacts and shields touch, when the header and receptacle are only partially mated. As the header and receptacle are further joined to the fully mated position, the point of connection between the tip of the ground contact and the ground shield moves from the tip of the ground shield toward the base of the ground shield. When fully mated, the tip of the ground contact is in electrical contact with the ground shield at a point proximate the base of the ground shield.

The signal performance is inferior for connector assemblies, in which the ground contact electrically engages the ground shield only proximate the base of the ground shield since the outer portion of the ground shield functions as a stub antenna to transmit electromagnetic (EM) interference. The EM interference caused by the ground shield interferes with the signal characteristics of the connector assembly.

A need remains for an improved connector assembly capable of satisfying small envelope dimensions, while affording high quality signal performance characteristics.

BRIEF SUMMARY OF THE INVENTION

At least one preferred embodiment of the present invention provides an electrical connector assembly having a receptacle connector mateable with a header connector in a small envelope while affording high quality signal performance. The assembly includes an insulated housing and a plurality of terminal modules mounted to the insulated housing. Each terminal module has an insulated molded body enclosing multiple connector contacts having opposed mating portions. Each terminal module includes contacts formed into at least one differential pair. The connector assembly further includes module ground shields mounted to and located between the terminal modules. Each module ground shield includes at least one ground contact pair located proximate at least one differential pair of connector contacts. The ground contact pair includes a primary ground contact extending a first distance from the module ground shield and a secondary ground contact extending a second distance from the module ground shield.

In accordance with at least one alternative embodiment, the module ground shield includes a main body portion with a first edge along one side adapted to mate with a printed circuit board and a second edge adjacent to the first edge. The second edge is adapted to be mounted in the insulated housing. Each terminal module may comprise a lead frame that includes conductive leads arranged in at least two pairs of leads. Each lead may include connector contacts at opposite ends thereof and be interconnected through intermediate conductive portions. Each terminal module may comprise a lead frame comprised of four differential pairs of conductive leads. Each conductive lead may have contacts located at opposite ends thereof interconnected through an in intermediate conductive portion.

In accordance with at least one alternative embodiment, the primary ground contacts are formed in V-shapes with a base attached to a body of the module ground shield and an apex located distally from the body. Optionally, the primary ground contact may surround the secondary ground contact, while the primary and secondary ground contacts move independent of one another. Optionally, the primary and secondary ground contacts may have first ends mounted to a body of the module ground shield and second ends located at first and second distances, respectively, from the body with the first distance being greater than the second distance. As a further alternative, the primary and secondary ground contacts may be adapted to electrically engage a corresponding header ground shield on the header contact. The primary ground contact may have a length sufficient to electrically engage the header ground shield proximate a base of the header ground shield. The secondary ground contact may have a length adapted to electrically engage the header ground shield at an intermediate point along a length thereof or proximate the outer tip of the header ground shield.

In accordance with a further alternative embodiment, the connector assembly includes a cover mounted to each terminal module. Optionally, the cover may include at least one differential shroud enclosing an associated differential pair of contacts. Each shroud may have at least one open face exposing one of the top and bottom sides of the contacts. As a further alternative, the cover may include multiple differential shrouds receiving corresponding differential pairs of contacts. Each shroud may include a floor, sidewall, and a center wall to form separate channels to closely retain each contact. As a further alternative, the cover may have an open side facing and located immediately adjacent the primary and secondary ground contacts.

BRIEF DESCRIPTION OF THE DRAWINGS

The foregoing summary, as well as the following detailed description of the preferred embodiments of the present invention, will be better understood when read in conjunction with the appended drawings. For the purpose of illustrating the invention, there is shown in the drawings, embodiments which are present preferred. It should be understood, however, that the present invention is not limited to the precise arrangements and instrumentality shown in the attached drawings.

DETAILED DESCRIPTION OF THE INVENTION

Figure 1:
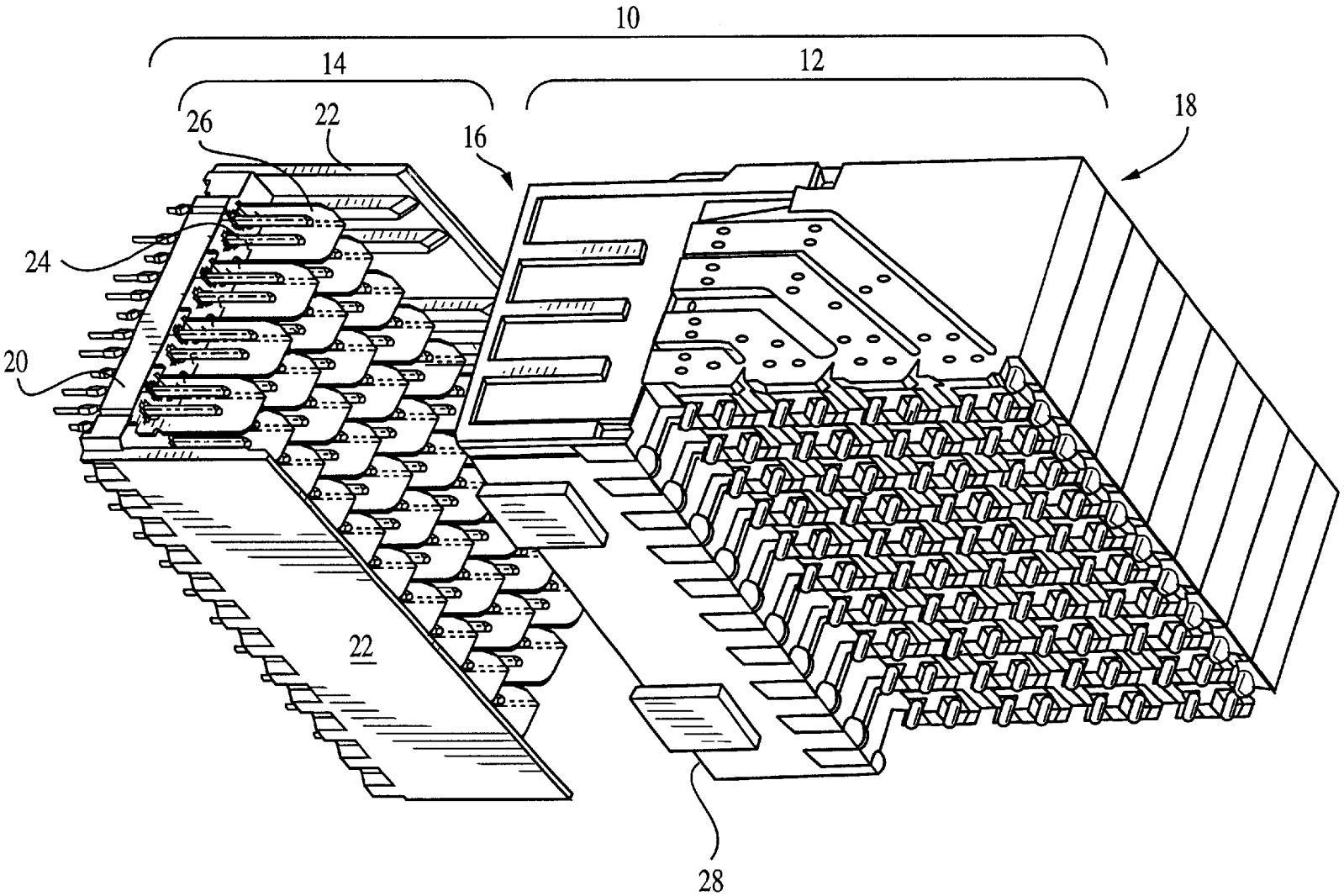
FIG. 1 illustrates an isometric view of a connector assembly formed in accordance with a preferred embodiment of the present invention.

FIG. 1 illustrates a connector assembly 10 including a receptacle 12 and a header 14. An insulated housing 16 is provided as part of the receptacle 12. Multiple terminal modules 18 (also referred to as chicklets) are mounted in the insulated housing 16. The header 14 includes a base 20 and sidewalls 22. The base 20 retains an array or matrix of header contacts 24 and header contact ground shields 26. By way of example only, the header contacts 24 may be formed as rectangular pins. The insulated housing 16 includes a mating face 28 having a plurality of openings therein aligned with the header contacts 24 and header contact ground shields 26. The header contact ground shields 26 and header contacts 24 are joined with receptacle contacts and receptacle grounds contained in the terminal modules 18 (as explained in more detail below).

Figure 2:
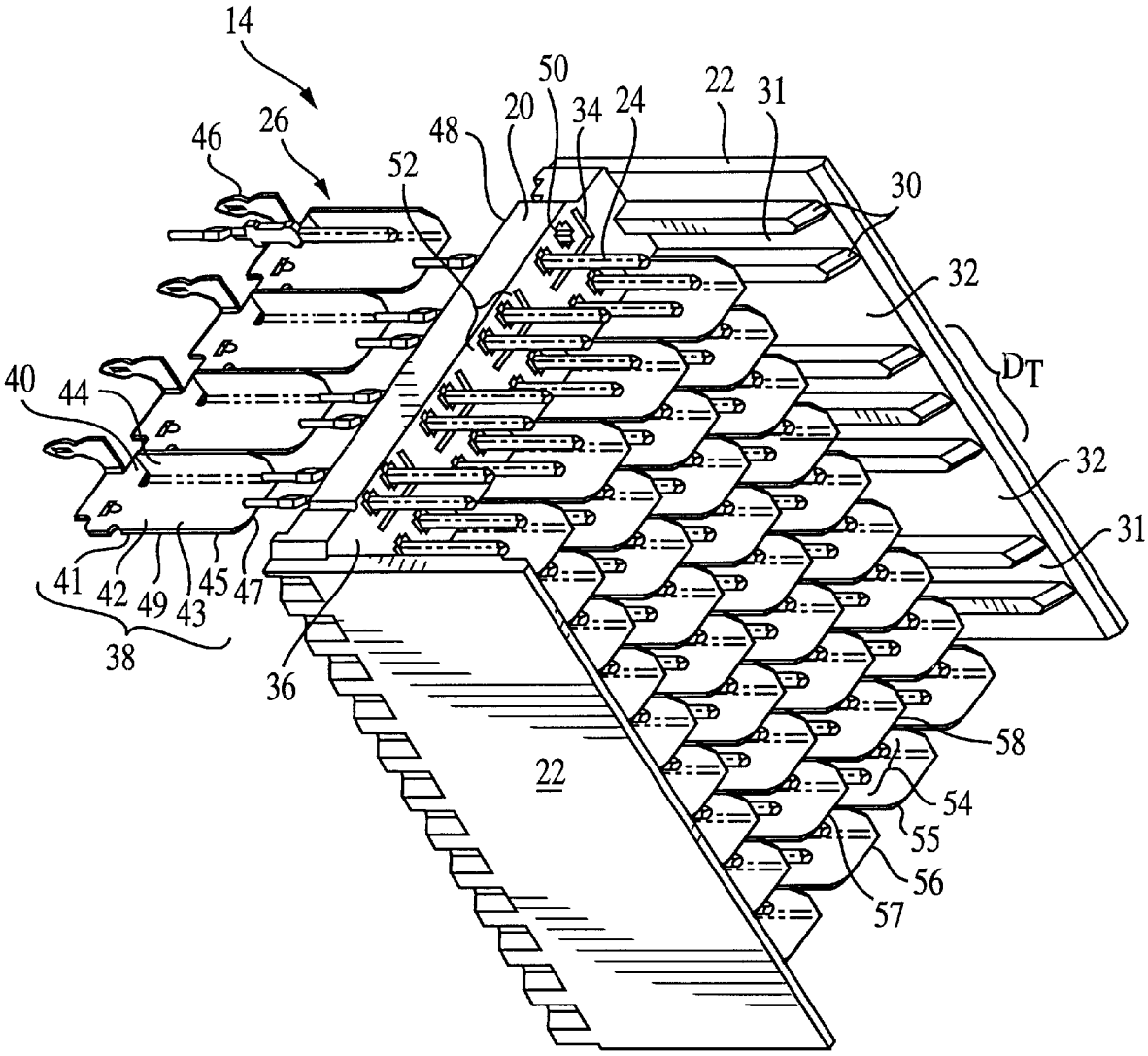
FIG. 2 illustrates an exploded isometric view of a header, header contacts and header ground shields formed in accordance with a preferred embodiment of the present invention.

FIG. 2 illustrates an isometric view of a header 14 in more detail. The sidewalls 22 include a plurality of ribs 30 formed on the interior surfaces thereof. Gaps 31 are formed between the ribs 30 as part of a void core manufacturing process. Void coring may be used to avoid the formation of sink holes in the sidewalls 22. Groups of ribs 30 may be separated by large gaps to form guide channels 32 that are used to guide the header 14 and receptacle 12 onto one another. The guide channels 32 may also be formed with different widths in order to operate as a polarizing feature to ensure that the receptacle 12 is properly oriented before mating with the header 14.

The base 20 of the header 14 includes a plurality of L-shaped notches 34 cut there through. The L-shaped notches 34 are aligned in rows and columns to define a matrix across the mating face 36 of the header 14. The mating face 36 abuts against the mating face 28 on the receptacle 12 when the connector assembly 10 is fully joined. The header 14 receives a plurality of ground shield segments 38, each of which includes four header contact ground shields 26 (in the example of FIG. 2). A ground shield segment 38 may be stamped from a single sheet of metal. Jumper straps 40 join the four header contact ground shields 26. Each header contact ground shield 26 includes a blade portion 42 and a leg portion 44 bent to form an L-shape. Ground shield contacts 46 are stamped from the same piece of metal as the remainder of the ground shield segment 38 and are integral with the four header contact ground shields 26. While not illustrated in FIG. 2, slots are provided along the rear surface 48 of the base 20 between notches 34 to receive the jumper straps 40 until flush with the rear surface 48. The slots between the notches 34 do not extend fully through the base 20 to the mating face 36. The blades 42 includes a front surface 43 and a rear surface 45, and base 41, an intermediate portion 49, and tip 47. The base 41 is formed with the jumper straps 40. The tip 47 extends beyond the outer end of the header contacts 24.

The base 20 also includes a plurality of header contact holes 50 cut there through. The header contact holes 50, in the example of FIG. 2, are arranged in pairs 52 in order to receive corresponding pairs of header contacts 24. Each pair 52 of holes 50 is located in the interior of a corresponding L-shaped notch 34 such that the associated pair of header contacts 24 are shielded on two sides by the blade portion 42 and leg portion 44 of the corresponding contact ground shields 26. By configuring the contact ground shields 26 to partially enclose each pair of header contacts 24, each pair of header contacts 24 is substantially surrounded on all sides by contact ground shields 26. By way of example, header contact pair 54 may be surrounded by blade and/or leg portions of contact ground shields 55–58. The contact ground shields 26 surround each pair of header contacts 24 to control the operating impedance of the connector assembly 10 when carrying high frequency signals.

Figure 3:
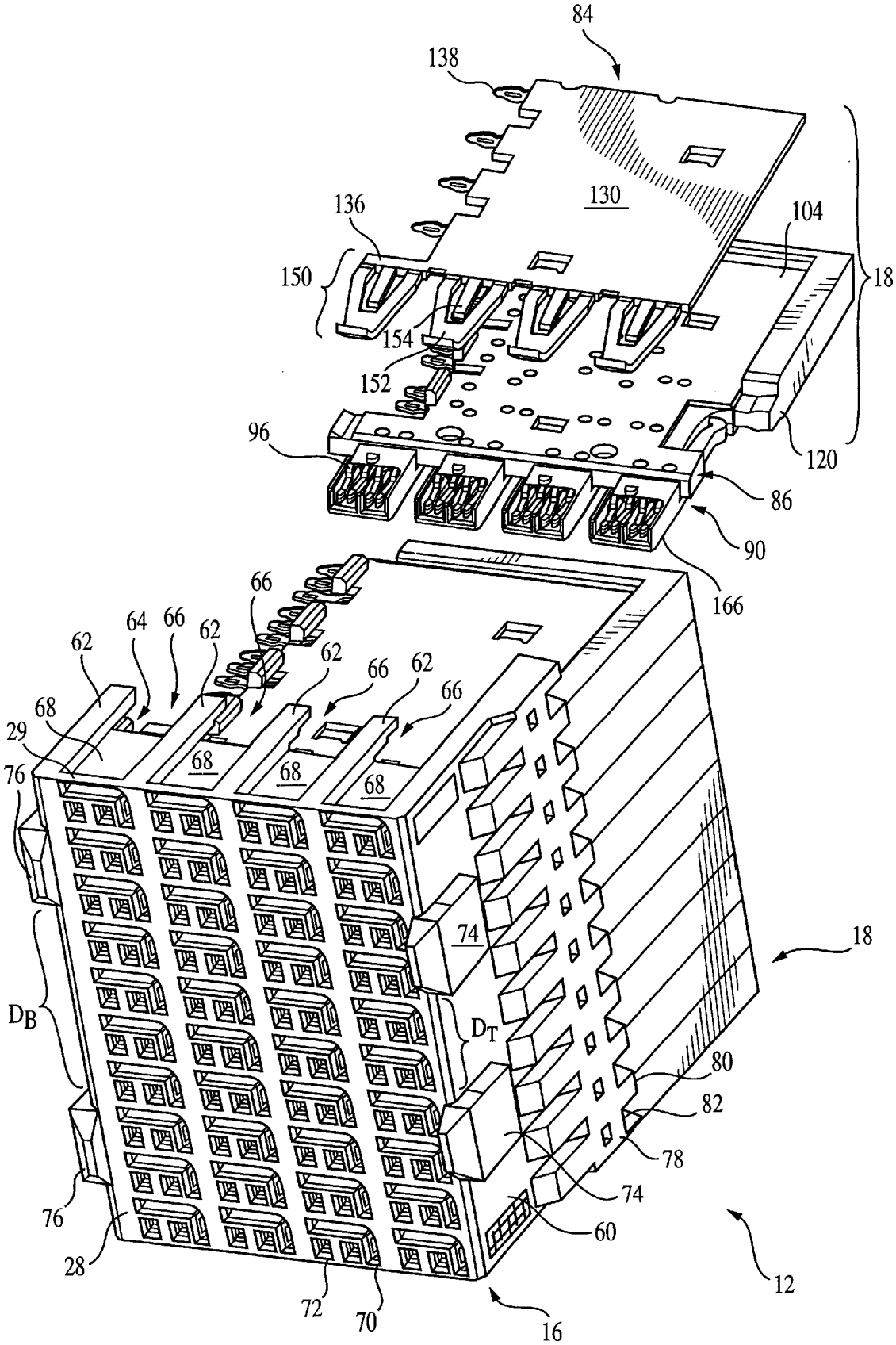
FIG. 3 illustrates an exploded isometric view of a receptacle formed in accordance with a preferred embodiment of the present invention.

FIG. 3 illustrates a receptacle 12, from which one terminal module 18 has been removed and partially disassembled. The receptacle 12 includes an insulated housing 16 formed with a mating face 28. The mating face 28 on the receptacle 12 is formed with a plurality of L-shaped notches 70 and contact receiving holes 72. The notches 70 and holes 72 are aligned to receive the contact ground shields 26 and header contacts 24 (FIG. 2).

A plurality of support posts 62 project rearward from the mating face 28 of the base 29 of the housing 16. The insulated housing 16 includes a top wall 60 formed with, and arranged to extend rearward from, the base 29. The top wall 60 and support posts 62 cooperate to define a plurality of slots 64, each of which receives one terminal module 18. The insulated housing 16 includes a plurality of top and bottom keying projections 74 and 76, respectively. The top keying projections 74 are spaced a distance $D_T$ apart from one another, while the bottom keying projections 76 are spaced a distance $D_B$ from one another. The distances $D_T$ and $D_B$ differ to distinguish the top and bottom keying projections 74 and 76 from one another. The keying projections 74 and 76 are received within the guide channels 32 (FIG. 2) located on the interior surfaces of the sidewalls 22 of the header 14. Both sidewalls 22 include ribs 30 and guide channels 32. The guide channels 32 viewable in FIG. 2 are spaced a distance $D_T$ from one another. While not illustrated in FIG. 2, similar guide channels are provided on the interior side of the opposite sidewall 22, but are spaced from one another by a distance $D_B$ to align with bottom keying projections 76.

The top wall 60 also includes a module support bracket 78 extending along a width of the top wall 60. The rear end 80 of the module support bracket 78 includes a plurality of notches 82 formed therein to receive upper ends of the terminal modules 18. Locking features are provided on the lower surface of the module support bracket 78 to secure the terminal modules 18 in place. The support posts 62 are formed in rows and columns. By way of example, the receptacle 12 in FIG. 3 illustrates four support posts 62 formed in each row, while the groups of four support posts 62 are provided in 11 columns. The support posts 62 define 10 slots 64 that receive 10 terminal modules 18. The support posts 62 and top wall 60 are spaced apart from one another to form, along each row of support posts 62, a series of gaps 66. In the example of FIG. 3, four gaps 66 are provided along each row of support posts 62. The gaps 66 between the support posts 62 and between the support posts 62 and top wall 60 are filled with thin insulating walls 68 that operate as a dielectric.

Figure 4:
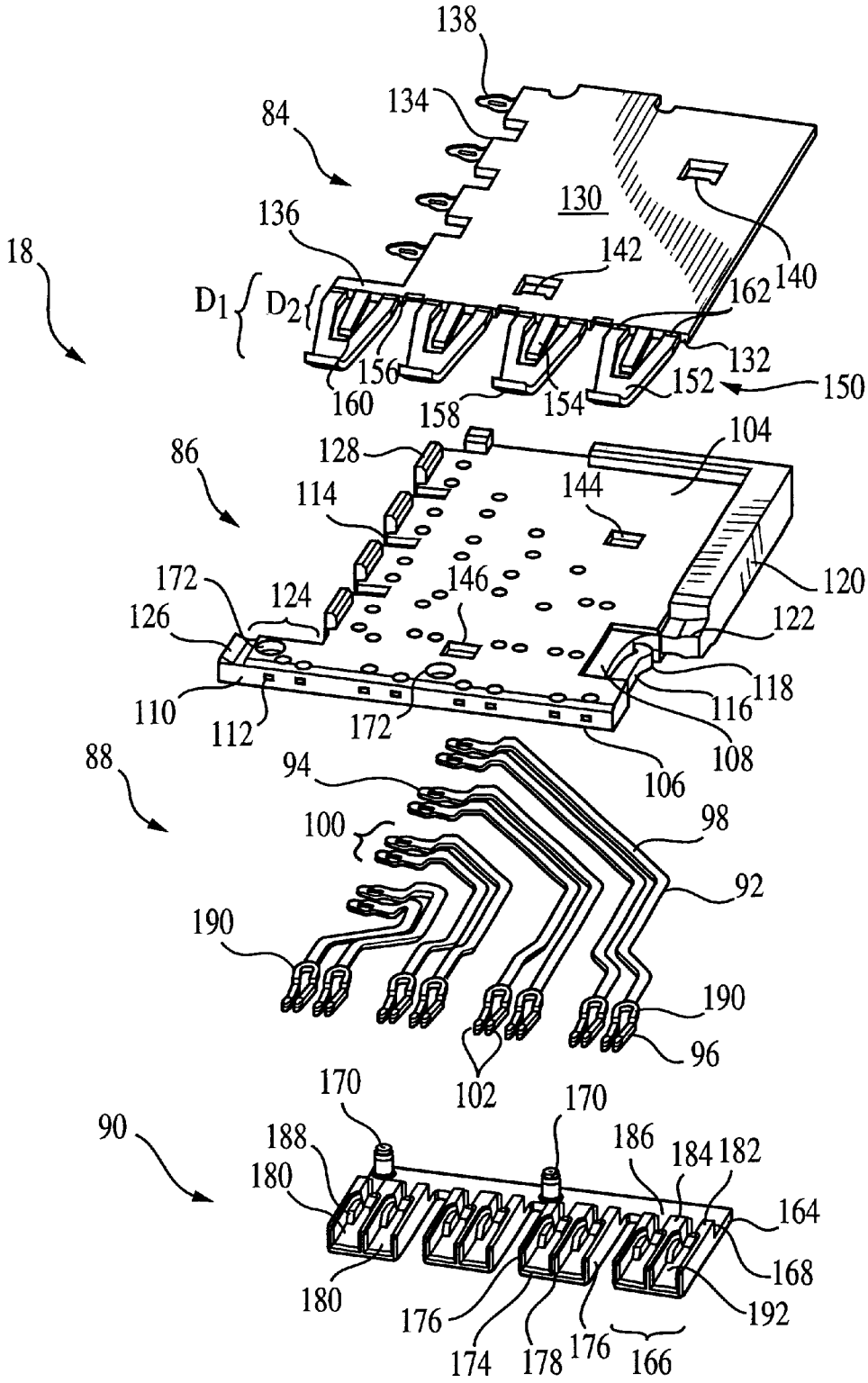
FIG. 4 illustrates an exploded isometric view of a terminal module formed in accordance with at least one preferred embodiment of the present invention.

FIG. 4 illustrates a terminal module 18 separated into its component parts. The terminal module 18 includes a module ground shield 84 that is mounted to a plastic over molded portion 86. The over molded portion 86 retains a lead frame 88. A cover 90 is mounted to one end of the over molded portion 86 to protect the receptacle contacts 96 that are located along one end of the lead frame 88. The lead frame 88 is comprised of a plurality of leads 92, each of which includes a board contact 94 and a receptacle contact 96. Each board contact 94 and corresponding receptacle contact 96 is connected through an intermediate conductive trace 98. By way of example, the leads 92 may be arranged in lead differential pairs 100. In the example of FIG. 4, four lead differential pairs 100 are provided in each terminal module 18. By way of example only, the receptacle contacts 96 may be formed in a "tuning fork"0 shape with opposed fingers 102 biased toward one another. The fingers 102 frictionally and conductively engage a corresponding header contact 24 when the receptacle 12 and header 14 are fully mated. The board contacts 94 may be inserted into corresponding slots in a computer board and connected with associated electrical traces.

The over molded portion 86 includes top and bottom insulated layers 104 and 106 that are spaced apart from one another to define a space 108 there between in which the lead frame 88 is inserted. The over molded portion 86 includes a front edge 110 having a plurality of openings 112 therein through which the receptacle contacts 96 project. The over molded portion 86 also includes a bottom edge 114 having a similar plurality of openings (not shown) through which the board contacts 94 extend. A latch arm 116 is provided along the top of the over molded portion 86. The latch arm 116 includes a raised ledge 118 on the outer end thereof to snappily engage a corresponding feature on the interior surface of the module support bracket 78. The over molded portion 86 includes an L shaped bracket 120 located along the top edge thereof and along the back edge to provide support and rigidity to the structure of the terminal module 18. The bracket 120 includes a V-shaped wedge 122 on a front end thereof. The V-shaped wedge 122 is slidably received within a corresponding inverted V-shape within the notches 82 in the module support bracket 78. The wedges 122 and notches 82 cooperate to insure precise alignment between the terminal module 18 and the insulated housing 16.

The terminal module 18 also includes an extension portion 124 proximate the front edge 110 and extending downward beyond the bottom edge 114. The extension portion 124 projects over an edge of a board upon which the terminal module 18 is mounted and into which the board contacts 94 are inserted. The outer end of the extension portion 124 includes a wedge embossment 126 extending outward at least along one side of the extension portion 124. The embossment 126 is received within a corresponding notch formed between adjacent support posts 62 along the bottom of the insulated housing 16 to insure proper alignment between the terminal module 18 and the insulated housing 16. The over molded portion 86 includes a series of projections 128 extending upward from the bottom edge 114. The projections 128 and bracket 120 cooperate to define a region in which the module ground shield 84 is received. The module ground shield 84 is mounted against the top layer 104 of the over molded portion 86. The module ground shield 84 includes a main body 130, with a front edge 132 and a bottom edge 134. An extended ground portion 136 is arranged along the front edge 132 and projects downward below the bottom edge 134. The extended ground portion 136 overlays the extension portion 124 to reside along an end of a board upon which the terminal module 18 is mounted. The bottom edge 134 includes a plurality of board grounding contacts 138 that conductably connect the module ground shield 84 to grounds on the board. The main body 130 includes two latching members 140 and 142 that extend through holes 144 and 146, respectively, in the top layer 104. The latch members 140 and 142 secure the module ground shield 84 to the over molded portion 86.

The module ground shield 84 includes a plurality of ground contact assemblies 150 mounted to the front edge 132. Each ground contact assembly 150 includes a primary ground contact 152 and a secondary ground contact 154. Each ground contact assembly 150 is mounted to the main body 130 through a raised ridge 156. The primary ground contacts 152 include outer ends 158 that are located a distance $D_1$ beyond the front edge 132. The secondary ground contacts 154 include an outer end 160 located a distance $D_2$ beyond the front edge 132. The outer end 158 of the primary ground contacts 152 is located further from the front edge 132 than the outer end 160 of the secondary ground contacts 154. In the example of FIG. 4, the primary ground contacts are V-shaped with an apex of the V forming the outer end 158, and base of the V-shape forming legs 162 that are attached to the main body 130. The tip of the outer ends 158 and 160 may be flared upward to facilitate engagement with the header contact ground shields 26.

The cover 90 includes a base shelf 164 and multiple differential shells 166 formed therewith. The base shelf 164 is mounted to the bottom layer 106 of the over molded portion 86, such that the rear end 168 of the differential shells 166 abut against the front edge 110 of the over molded portion 86. Mounting posts 170 on the cover 90 are received within holes 172 through the top and bottom layers 104 and 106. The mounting posts 170 may be secured to the holes 102 in a variety of manners, such as through a frictional fit, with adhesive and the like. Each differential shell 166 includes a floor 174, sidewalls 176 and a center wall 178. The side and center walls 176 and 178 define channels 180 that receive the receptacle contacts 96. The rear ends of the sidewalls 176 and center walls 178 include flared portions 182 and 184 that extend toward one another but remain spaced apart from one another to define openings 186 there between. Ramp blocks 188 arc provided along the interior surfaces of the sidewalls 176 and along opposite sides of the center walls 178 proximate the rear ends thereof. The ramped blocks 188 support corresponding ramped portions 190 on the receptacle contacts 96.

The side walls 176, center wall 178, flared portions 182 and 184, and ramp blocks 188 define a cavity comprising the channel 180 and opening 186. The cavity closely proximates the shape of the fingers 102 on receptacle contacts 96. The walls of the cavity are spaced from the receptacle contacts 96 by a very narrow gap, such as approximately 0.1 mm. Hence, the contour of the cavity walls closely match the contour of the receptacle contacts 96, thereby enhancing the electrical performance.

The differential shells 166 include at least one open side. In the example of FIG. 4, each differential shell 166 includes an open top side 192. The top side 192 is maintained open to enhance electrical performance by enabling the receptacle contacts 96 to be inserted into the cover 90 in a manner in which the fingers 102 of each receptacle contact 96 arc closely spaced to the sidewalls 176, center wall 178, flared portions 182 and 184, and ramped portions 190. The open top side 192 is maintained opened to enable the receptacle contacts 96 to be inserted into the differential shells 166 in a manner having a very close tolerance. The insulated walls 68 on the housing 16 close the open top sides 192 of each differential shell when the terminal modules 18 are inserted into the housing 16.

Figure 5:
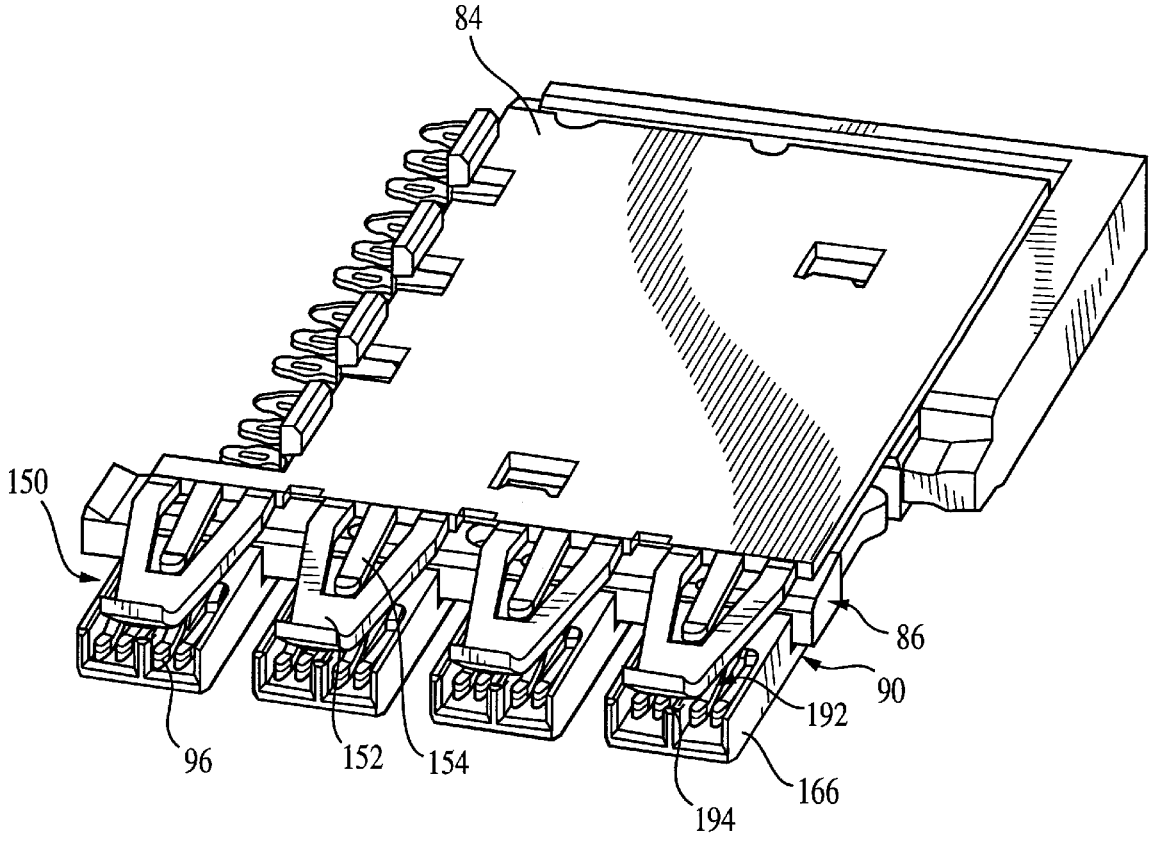
FIG. 5 illustrates an isometric view of a terminal module formed in accordance with a preferred embodiment of the present invention.

FIG. 5 illustrates a terminal module 18 with the module ground shield 84 fully mounted upon the over molded portion 86. The cover 90 is mounted to the over molded portion 86. The ground contact assemblies 150 are located immediately over the open top sides 192 of each differential shell 166 with a slight gap 194 there between. The primary and secondary ground contacts 152 and 154 are spaced a slight distance above the receptacle contacts 96.

Figure 6:
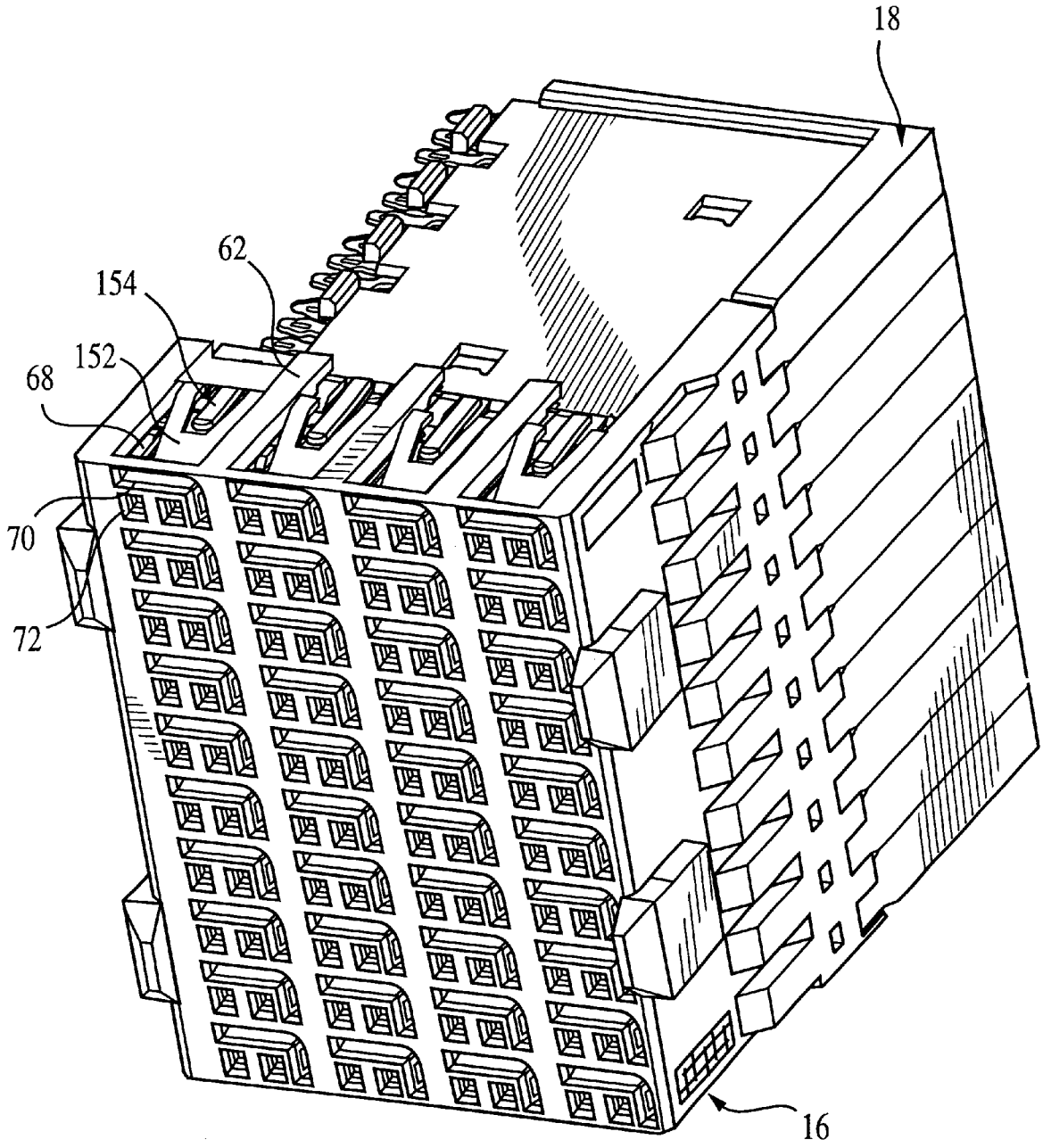
FIG. 6 illustrates an isometric view of a receptacle formed in accordance with a preferred embodiment of the present invention.

As illustrated in FIG. 6, when the terminal module 18 is inserted into the insulated housing 16, the insulated walls 68 are slid along gaps 194 between the ground contact assemblies 150 and receptacle contacts 96. By locating the insulated walls 68 over the open top sides 192 of each differential shell 166, the connector assembly 10 entirely encloses each receptacle contact 96 within an insulated material to prevent arching between receptacle contacts 96 and the ground contact assemblies 150. Once the terminal modules 18 are inserted into the insulated housing 16, the primary and secondary ground contacts 152 and 154 align with the L-shaped notches 70 cut through the mating face 28 on the front of the insulated housing 16. The receptacle contacts 96 align with the contact receiving holes 72. When interconnected, the header contact ground shields 26 are aligned with and slid into notches 70, while the header contacts 24 are aligned with and slid into contact receiving holes 72.

As the header contact ground shields 26 are inserted into the notches 70, the primary ground contact 152 initially engages the tip 47 of the rear surface 45 of a corresponding blade portion 42. The primary ground contacts 152 are dimensioned to engage the tip 47 of the header contact ground shield 26 before the header and receptacle contacts 24 and 96 touch to prevent shorting and arching. As the header contact ground shields 26 are slid further into the notches 70, the tips 47 of the blade portions 42 engage the outer ends 160 of the secondary ground contact 154 and the outer ends 158 of the primary ground contacts 152 engage the intermediate portion 49 of the black portion 42. When the receptacle 12 and header 14 are in a fully mated position, the outer end 158 of each primary ground contact 152 abuts against and is in electrical communication with a base 41 of a corresponding blade portion 42, while the outer end 160 of the secondary ground contact 154 engages the blade portion 42 at an intermediate point 49 along a length thereof. Preferably, the outer end 160 of the secondary ground contact 154 engages the blade portion 42 proximate the tip 47 thereof.

The primary and secondary ground contacts 152 and 154 move independent of one another to separately engage the header contact ground shield 26. By engaging the header contact ground shield 26 at an intermediate portion 49 with the secondary ground contact 154, the header contact ground shield 26 does not operate as a stub antenna and does not propagate EM interference. Optionally, the outer end 160 of the secondary ground contact 154 may engage the header contact ground shield 26 at or near the tip 47 to further prevent EM interference. The length of the secondary ground contacts 154 effects the force needed to fully mate the receptacle 12 and header 14. Thus, the secondary ground contacts 154 are of sufficient length to reduce the mating force to a level below a desired maximum force. Thus in accordance with at least one preferred embodiment, the primary ground contacts 152 engage the header contact ground shield 26 before the header and receptacle contacts 24 and 96 engage one another. The secondary ground contact 154 engage the header contact ground shields 26 as close as preferable to the tip 47, thereby minimizing the stub antenna length without unduly increasing the mating forces.

Optionally, the ground contact assembly 150 may be formed on the header 14 and the ground shields 26 formed on the receptacle 12. Alternatively, the ground contact assemblies 150 need not include v-shaped primary ground contacts 152. For example, the primary ground contacts 152 may be straight pins aligned side-by-side with the secondary ground contacts 154. Any other configuration may be used for the primary and secondary contacts 152 and 154 so long as they contact the ground shields 26 at different points.

Additional inventive features of the connector assembly are described in more detail in a co-pending application Ser. No. 09/772,642 filed on the same day as the present application and entitled "Terminal Module Having Open Side For Enhanced Electrical Performance." The co-pending application names Robert Scott Kline as the sole inventor and is assigned to the same assignee as the present application and is incorporated by reference herein in its entirety including the specification, drawings, claims, abstract and the like.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. An electrical connector assembly having a receptacle connector mateable with a header connector operable in at least differential pair applications, comprising;

an insulated housing;

a plurality of terminal modules mountable to said insulated housing, each terminal module having an insulated body enclosing multiple signal conductors with signal contacts on opposed ends, said signal conductors and signal contacts being formed in differential pairs; and module ground shields mounted to and located between said terminal modules, each module ground shield including at least one ground contact assembly located proximate a respective differential pair of signal contacts, said at least one ground contact assembly including a primary ground contact extending a first perpendicular distance from an edge of a respective module ground shield and a secondary ground contact extending a second perpendicular distance from said edge of said respective module ground shield.

2. The electrical connector assembly of claim 1, wherein each module ground shield includes a main body portion with a first edge along one side adapted to mate with a board and a second edge adjacent said first edge, said second edge being adapted to join said insulated housing.

3. The electrical connector assembly of claim 1, wherein each terminal module comprises a lead frame, said lead frame including conductive leads arranged in at least two differential pair of leads, each conductive lead having signal contacts at opposite ends thereof, said signal contacts being interconnected through intermediate conductive portions.

4. The electrical connector assembly of claim 1, wherein each terminal module comprises a lead frame comprised of four differential pairs of conductive leads, each conductive lead having signal contacts located at opposite ends thereof, said signal contacts being interconnected through an intermediate conductive portion.

5. The electrical connector assembly of claim 1, wherein said primary ground contacts are V-shaped with a base attached to a body of said module ground shield and an apex located distally from said body.

6. The electrical connector assembly of claim 1, said primary ground contact surrounds said secondary ground contact, said primary and secondary ground contacts moving independent of one another.

7. The electrical connector assembly of claim 1, wherein said primary and secondary ground contacts have first ends mounted to said edge of said module ground shield and have second ends located said first and second distances, respectively, from said edge, said first distance being greater than said second distance.

8. The electrical connector assembly of claim 1, wherein said primary and secondary ground contacts are adapted to electrically engage a corresponding header ground shield on a header connector when said insulated housing is mated with the header connector, said primary ground contact having a length sufficient to electrically engage said corresponding header ground shield proximate a base of said header ground shield, said secondary ground contact having a length adapted to electrically engage said corresponding header ground shield at an intermediate point along a length of said corresponding header ground shield.

9. The electrical connector assembly of claim 1, further comprising:

a header connector having header signal contacts and header ground contacts matable with said signal contacts and ground contact assemblies, said header ground contacts having blade portions and leg portions formed in an L-shape to partially enclose a differential pair of signal contacts.

10. The electrical connector assembly of claim 1, wherein said ground contact assemblies and signal contacts are optimized for use in a differential pair application.

11. The electrical connector assembly of claim 1, wherein each module ground shield includes a lower edge having multiple pins thereon to electrically engage a ground plane on a printed circuit board.

12. A connector assembly comprising:

header connector having a plurality of header signal and ground terminals arranged in a matrix of rows and columns, each header ground terminal having a base portion, an intermediate portion and a tip, said base and intermediate portions being located at different respective distances from said tip; and a receptacle connector having a plurality of receptacle signal and ground terminals arranged in a matrix of rows and columns matching said matrix of said header connector;

each receptacle ground terminal having multiple contact points that independently and separately electrically engage said base and intermediate portions of a corresponding said header ground terminal when said header and receptacle connectors are fully joined.

13. The connector assembly of claim 12, wherein said header ground terminals further include end portions, said contact points electrically engaging at least two of said base, intermediate and end portions.

14. The connector assembly of claim 12, wherein each receptacle ground terminal includes first and second ground contacts, said first ground contact having an outer end extending beyond an outer end of a respective receptacle signal terminal, and wherein said outer end of said receptacle signal terminal extends beyond an outer end of said second ground contact.

15. The connector assembly of claim 12, wherein said header and receptacle signal terminals are arranged in differential pairs that are surrounded by header and receptacle ground terminals.

16. The connector assembly of claim 12, further comprising:

a plurality of terminal modules having signal contacts along adjacent edges to form a right angled connector.

17. The connector assembly of claim 12, wherein said header ground terminals include a blade portion and a leg portion joined in an L-shape, said contact points on each receptacle ground terminal electrically engaging base and outer portions of a rear side of said blade portion of a corresponding header ground terminal.

18. The connector assembly of claim 12, wherein groups of said receptacle ground terminals are formed as ground shield segments stamped from a common piece of metal.

19. The connector assembly of claim 12, wherein said header connector includes a base having a plurality of notches cut therethrough, said notches securely retaining said header ground terminals.

20. The connector assembly of claim 12, wherein said header and receptacle connectors include side walls having keying features to ensure proper orientation and alignment when joined with one another.

21. The connector assembly of claim 12, further comprising:

a plurality of terminal modules, each terminal module including a lead frame having said receptacle signal terminals on one end, an insulated over molded portion surrounding said lead frame, and a module ground shield attached to one side of said over molded portion, said module ground shield having said receptacle ground terminals on one end thereof.

22. An electrical connector comprising:

an insulated housing;

a terminal module mountable to said insulated housing, said terminal module having an insulated body enclosing a signal conductor with signal contacts on opposed ends of said signal conductor; and a ground shield mounted to and located adjacent said terminal module, said ground shield including a body having an edge, and primary and secondary ground contacts mounted to said body, said primary and secondary contacts extending first and second different respective perpendicular distances from said edge of said body.

23. A connector assembly comprising:

a header connector having a header signal terminal and a header ground terminal, said header ground terminal having a body with a tip; and a receptacle connector having a receptacle signal terminal and a receptacle ground terminal, said receptacle ground terminal having multiple separate contact points that engage said body of said header ground terminal at respective locations that are at different respective distances from said tip of said header ground terminal when said header and receptacle connectors are fully joined.

* * * * *